US006692238B2

(12) United States Patent
Myung et al.

(10) Patent No.: US 6,692,238 B2
(45) Date of Patent: Feb. 17, 2004

(54) MUFFLER OF COMPRESSOR

(75) Inventors: Hwan Joo Myung, Gwangmyeong (KR); In Seop Lee, Uiwang (KR)

(73) Assignee: LG Electronics Inc., Seoul (KR)

( * ) Notice: Subject to any disclaimer, the term of this patent is extended or adjusted under 35 U.S.C. 154(b) by 97 days.

(21) Appl. No.: 09/948,772

(22) Filed: Sep. 10, 2001

(65) Prior Publication Data

US 2002/0090305 A1 Jul. 11, 2002

(30) Foreign Application Priority Data

Jan. 11, 2001 (KR) ..... 2001-1607

(51) Int. Cl.[7] ..... F04B 39/00
(52) U.S. Cl. ..... 417/312
(58) Field of Search ..... 417/312, 902, 417/519, 423.8, 357, 311, 423.1; 181/281, 229, 249, 403

(56) References Cited

U.S. PATENT DOCUMENTS 4,370,104 A * 1/1983 Nelson et al. ..... 417/312
4,960,368 A * 10/1990 Lilie ..... 417/312
5,435,700 A * 7/1995 Park ..... 417/312
5,451,727 A * 9/1995 Park ..... 181/229
6,017,197 A * 1/2000 Jensen et al. ..... 417/312
6,149,402 A * 11/2000 Kim ..... 417/312
6,296,457 B1 * 10/2001 Shintoku et al. ..... 417/312
6,415,888 B2 * 7/2002 An et al. ..... 181/281
6,446,454 B1 * 9/2002 Lee et al. ..... 62/296
6,520,289 B1 * 2/2003 Bo ..... 181/229

* cited by examiner

*Primary Examiner*—Teresa Walberg
*Assistant Examiner*—Vinod D. Patel

(57) ABSTRACT

A muffler of a compressor in which an imaginary central line of flowing direction in a passage pipe at an inlet side and an imaginary central line of the flowing direction in a passage pipe at an outlet side are formed to have an angle of 40~50° or a curved surface having a certain curvature is formed in an extended space between an outlet end of the passage pipe at the inlet side and an outlet end of the passage pipe at the outlet side. Accordingly, the refrigerant gas which flows to the passage pipe at the outlet side through the passage pipe at the inlet side can flow smoothly as the refrigerant gas passes the curved surface and by attenuating pulsation flow between the passage pipes at the inlet side and outlet side, the refrigerant gas can be sucked smoothly. Therefore, suction amount of the refrigerant gas increases, thus to improve the efficiency of the compressor.

17 Claims, 6 Drawing Sheets

MUFFLER OF COMPRESSOR

BACKGROUND OF THE INVENTION

1. Field of the Invention

The present invention relates to a muffler of a compressor and particularly to a muffler of a compressor in which flow of refrigerant gas is smooth and pulsation flow can be decreased.

2. Description of the Background Art

Generally, a muffler applied to a compressor is installed at a suction side or discharge side of a compressor so as to attenuate suction noise occurred when sucking fluid or discharge noise occurred when discharging fluid.

A muffler installed at the suction side is called as a suction muffler and a muffler installed at the discharge side is called as a discharge muffler.

A suction muffler and a discharge muffler decrease pulsation phenomenon occurred periodically when sucking and discharging fluid.

Also, a suction muffler and a discharge muffler attenuate compressor noise by blocking valve noise occurred when sucking and discharging fluid and flow noise of fluid.

Hereinafter, a suction muffler applied to a reciprocating type compressor will be described.

FIG. 1 is a longitudinal cross-sectional view showing an example of a reciprocating compressor having a conventional muffler of a compressor.

As shown in FIG. 1, a conventional reciprocating compressor is comprised of a casing 1 which is filled with oil, a electric motor unit which is installed in the inner lower part of the compressor to generate driving force by power supply from the outside of the compressor, and a compression unit which is installed in the upper part of the electric motor unit receiving driving force of the electric motor unit to suck and compress gas.

The compression unit includes a frame 2 which is fixed inside of the casing 1 in the horizontal direction, a cylinder 3 which is fixed at one side of the frame 2, a driving shaft 5 which penetrates the center of the frame 2 and is pressed-fitted to a rotor 4B of the electric motor unit, a connecting rod 6 which is connected with the upper eccentric part of the driving shaft 5 to change a rotational motion to a reciprocating motion, a piston 7 which is connected with the connecting rod 6 and which performs a reciprocating motion in the cylinder 3, a valve assembly 8 assembled to the cylinder 3 to control the suction and discharge of refrigerant gas, a head cover 9 which is combined to the valve assembly 8 having a certain discharge space (DS), a suction muffler 10 which is connected to one side of the head cover 9 so that the muffler 10 is connected to the valve assembly 8 and a discharge muffler (DM) which is installed in the cylinder 3 to be connected to the discharge side of the valve assembly 8.

The suction muffler 10 as shown in FIG. 2A, comprises an inlet port 11 which is connected to the refrigerant suction channel SP (shown in FIG. 1) which penetrates the inner part of the casing 1 or the casing 1 itself, an outlet port 12 which is connected to the suction side of the valve assembly 8 to lead the refrigerant gas flown through the inlet port 11 to a compression space of the cylinder 3(shown in FIG. 1), first compartment 13 and second compartment 14 for dividing the inner volume between the inlet port 11 and the outlet port 12 to first, second and third extended spaces S1, S2 and S3, first passage pipe 15 for connecting the first extended space S1 and the second extended space S2 by penetrating the first compartment 13 vertically, second passage pipe 16 for connecting the second extended space S2 to the outlet port 12, and a resonance hole 17 for connecting the third extended space S3 to the outlet port 12 so that the second passage pipe 16 is formed penetrating the peripheral wall at a center of the second passage pipe 16 and forming a Helmholtz Reservoir together with the third extended space S3.

In FIG. 1, reference numeral 4A designates a stator, 18 designates an oil drain hole, C designates a support spring, O designates an oil feeder and SP designates a compressor suction channel.

A conventional reciprocating compressor having the above structure is operated as follows.

Firstly, power is supplied to the electric motor unit and the rotor 4B rotates by the interaction of the stator 4A and the rotor 4B.

The rotor 4B rotates together with the driving shaft 5 and the rotational motion is changed to a linear reciprocating motion by the connecting rod 6 which is combined to the eccentric part of the driving shaft 5 and the linear reciprocating motion is transmitted to the piston 7.

The piston 7 sucks, compresses and discharges the refrigerant gas performing a reciprocating motion in the cylinder 3 and pulsating pressure and noise occurred during the process, flow in the opposite direction of the flow direction of refrigerant gas and are attenuated by the suction muffler 10.

This operation will be described in more detail as follows.

In case of a suction stroke in which the piston 7 moves from a top dead point to a bottom dead point, the refrigerant gas filled in the second extended space S2 opens the suction valve (not shown). Then the refrigerant gas is sucked to the compression space of the cylinder 3 and at the same time, new refrigerant gas is flown to the second extended space S2 through the refrigerant inlet port 11, the first extended space S1 and the first passage pipe 15.

On the other hand, in case of a compression stroke in which the piston 7 moves from a bottom dead point to a top dead point, the discharge valve (reference numeral is not shown) is opened at the same time as the suction valve (reference numeral is not shown) is closed and the compressed gas is discharged to the discharge space DS of the head cover 9 through the discharge valve.

At this time, repeated pulsating pressure is occurred continuously in the suction muffler 10 and the head cover 9 in the repeating process of suction and discharge of the refrigerant gas.

This pulsating pressure having phase difference is transmitted through each channel of the suction muffler 10. However, consequently the pulsating pressure greatly decreases at the inlet port 11 and the refrigerant gas flows smoothly since the pulsating pressure is attenuated gradually and almost removed.

Meanwhile, the noise occurred during suction of the refrigerant gas is converted to a heat energy by diffusion and dissipation and attenuated passing through the respective passage pipes 15 and 16, and extended spaces S1 and S2, and at the same time, the noise having a certain frequency is attenuated by the Helmholtz's Effect at the Helmholtz resonance portion which comprises a resonance hole of the second passage pipe 16 and the third extended space S3. Accordingly, the whole noise decreases.

However, in the above conventional suction muffler, the inlet port 11 which forms a suction channel, the first passage pipe 15, and the second passage pipe 16 are positioned in parallel to each other and accordingly, the refrigerant gas flows in zigzags.

Therefore, by the flow of the refrigerant gas in zigzags, a smooth flow of the refrigerant gas is interrupted and the refrigerant gas flown from the inlet port 11, the first passage pipe 15, and the second passage pipe 16 collides with the walls of the respective extended spaces S1, S2 and S3. Accordingly, the speed energy of the refrigerant gas is converted to a collision energy and thus to cause flow loss.

Also, in another conventional suction muffler as shown in FIG. 2B, first passage pipe 21 (inlet port in drawings) and second passage pipe 22 form a right angle each other, or in the other conventional suction muffler as shown in FIG. 2C, first passage pipe 31 is positioned on a straight line with the second passage pipe 32 thus to improve flow of refrigerant gas.

However, in the suction muffler shown in FIG. 2B, the refrigerant gas sucked through the first passage pipe 21 is collided in an extended space 23 and then flown to the second passage 22. Accordingly, flow loss by collision still remains.

On the other hand, in the suction muffler shown in FIG. 2C, the pulsation flow transmitted to the first passage pipe 31 in the operation of the compressor collides with the refrigerant gas sucked through the second passage pipe 32 and interrupts the flow of the refrigerant gas. Therefore, due to the decrease in amount of the sucked gas, efficiency of the compressor decreases.

Reference numeral 24 designates a resonance hole, 25 designates a resonance space, 33 designates a extended space, 34 and 36 designate resonance holes and 35 and 37 designate resonance spaces.

SUMMARY OF THE INVENTION

Therefore, an object of the present invention is to provide a muffler of a compressor which can minimize flow resistance of suction channel when sucking refrigerant gas and flow resistance of pulsation flow.

To achieve these and other advantages and in accordance with the purpose of the present invention, as embodied and broadly described herein, there is provided a muffler of a compressor, having an outlet end of a passage pipe at an inlet side and an inlet end of a passage pipe at an outlet side on the basis of suction direction of fluid connected together by an extended space, wherein an imaginary central line of flowing direction in the passage pipe at the inlet side and an imaginary central line of the flowing direction in the passage pipe at the outlet side are formed to have an angle of 40~50°.

There is also provided a muffler of a compressor, having an outlet end of a passage pipe at an inlet side and an inlet end of a passage pipe at an outlet side on the basis of suction direction of fluid connected together by an extended space, wherein a curved surface having a certain curvature is formed in the extended space between the outlet end of the passage pipe at the inlet side and the outlet end of the passage pipe at the outlet side.

There is also provided a muffler of a compressor, having an outlet end of a passage pipe at an inlet side and an inlet end of a passage pipe at a outlet side on the basis of suction direction of fluid connected together by an extended space, wherein an imaginary central line of flowing direction in the passage pipe at the inlet side and an imaginary central line of the flowing direction in the passage pipe at the outlet side are formed to have an angle of 40~50° and a curved surface having a certain curvature is formed in the extended space between the outlet end of the passage pipe at the inlet side and the inlet end of the passage pipe at the outlet side.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
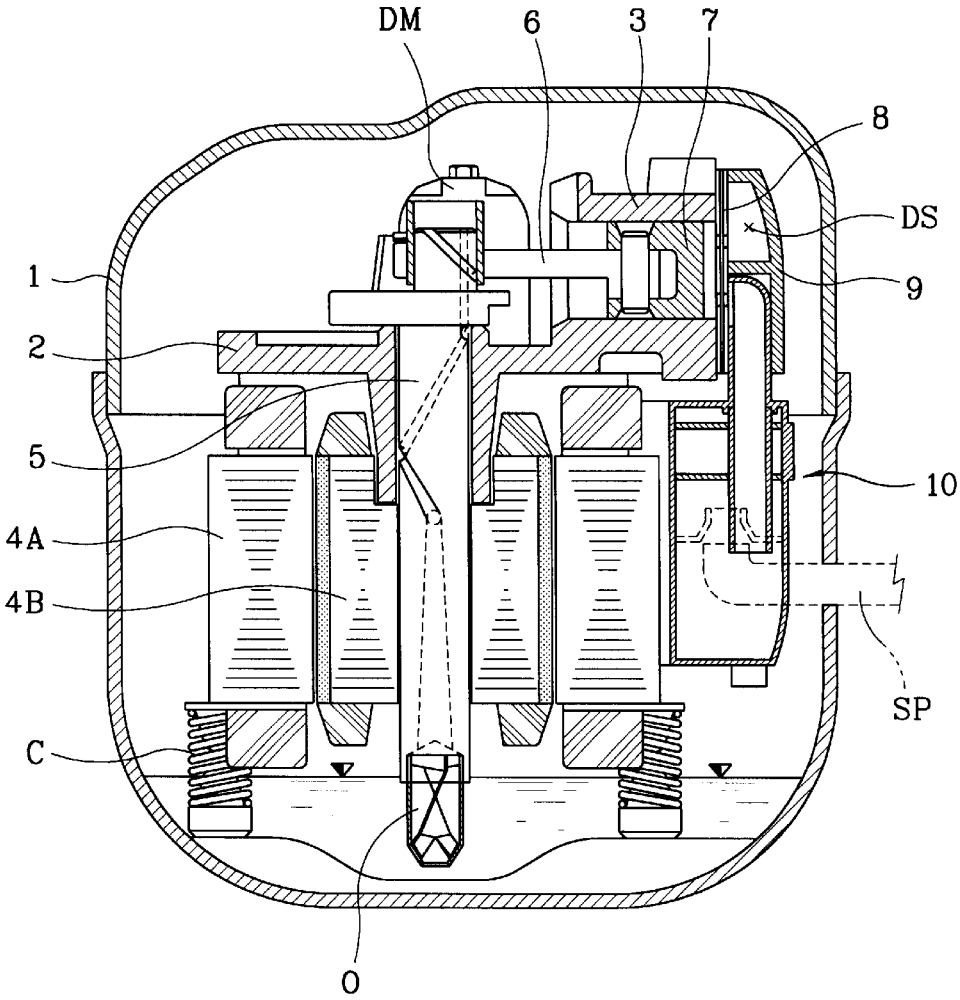
FIG. 1 CONVENTIONAL ART
FIG. 1 is a longitudinal cross-sectional view showing an example of a reciprocating compressor having a conventional muffler of a compressor.
Figure 2A:
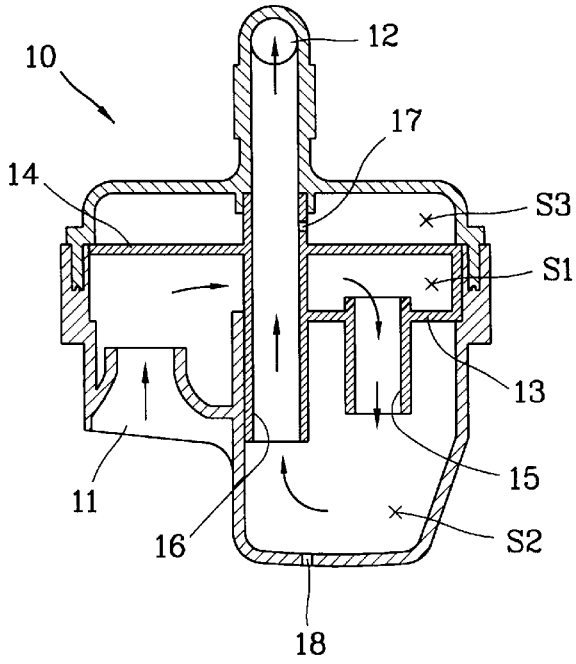
FIG. 2A CONVENTIONAL ART
FIGS. 2A, 2B and 2C are longitudinal cross-sectional views showing an example of a conventional muffler of a compressor.
Figure 2B:
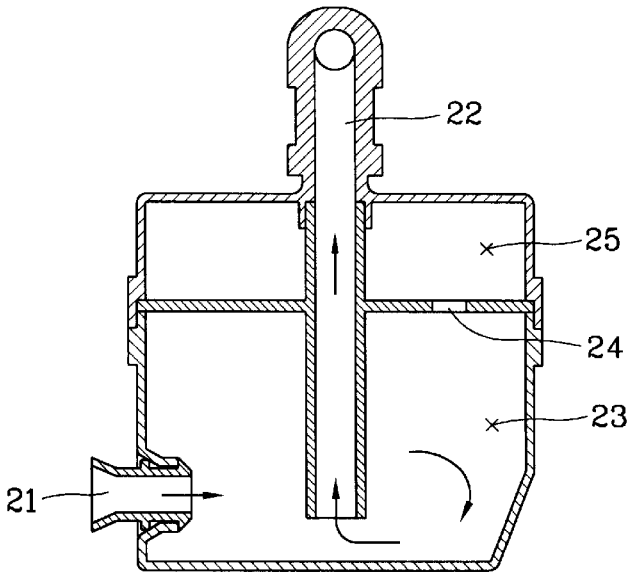
FIG. 2B CONVENTIONAL ART
Figure 2C:
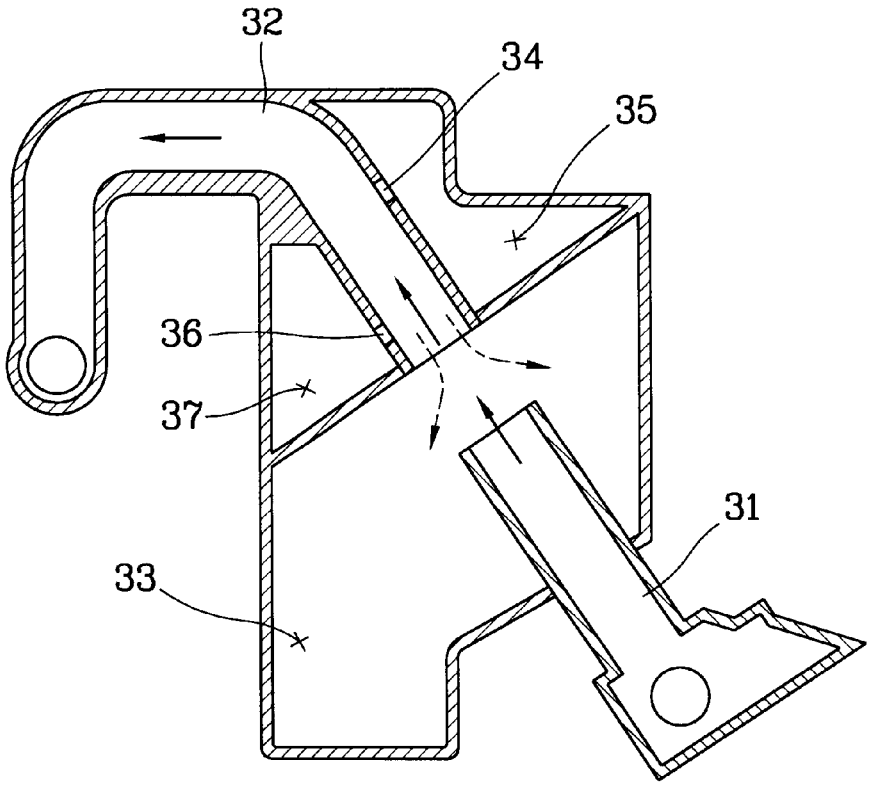
FIG. 2C CONVENTIONAL ART
Figure 3:
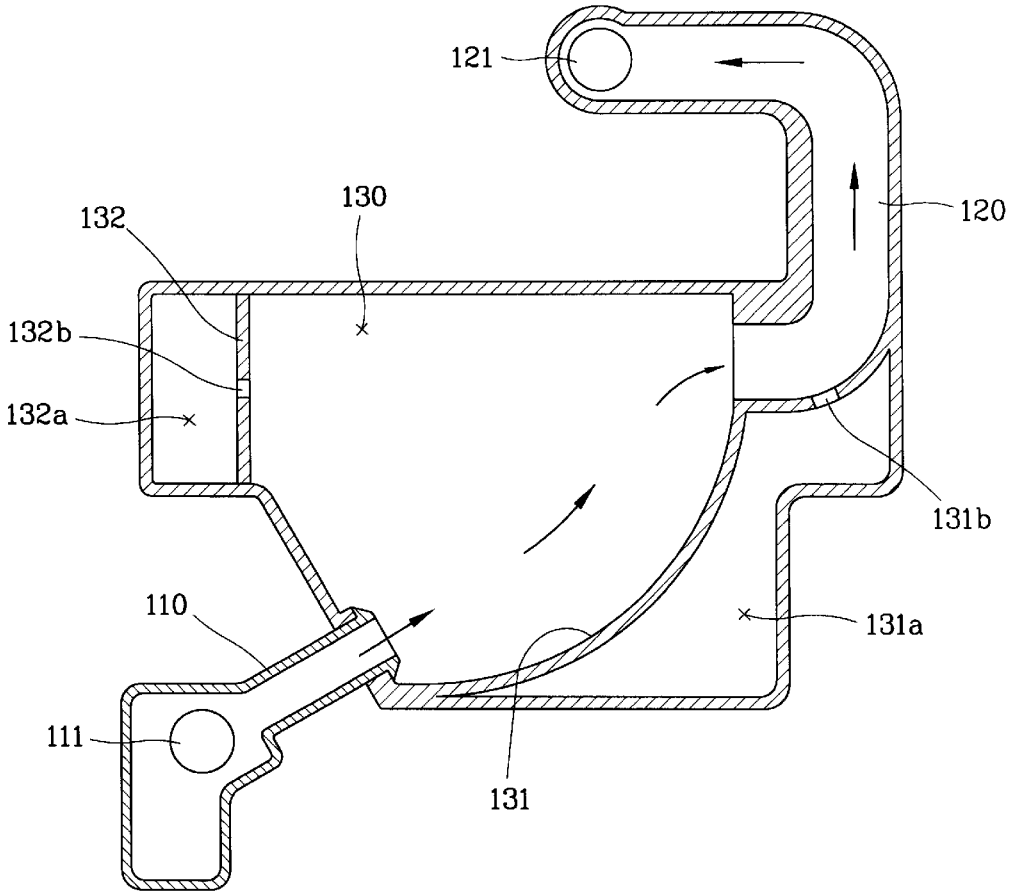
FIG. 3 is a longitudinal cross-sectional view showing an example of a muffler of a compressor in accordance with the present invention.
Figure 4:
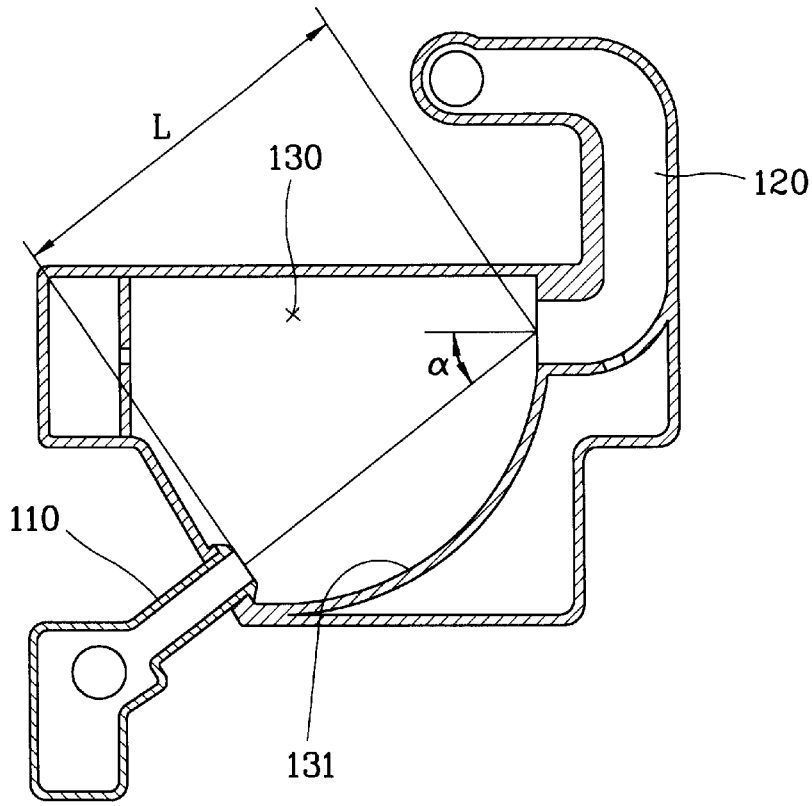
FIG. 4 is a longitudinal cross-sectional view illustrating respective sizes in a muffler of a compressor in accordance with the present invention.

FIG. 3 is a longitudinal cross-sectional view showing an example of a muffler of a compressor in accordance with the present invention and FIG. 4 is a longitudinal cross-sectional view illustrating respective sizes in the muffler of a compressor in accordance with the present invention.

As shown in FIGS. 3 and 4, a suction muffler in accordance with the present invention comprises first passage pipe 110 where an inlet port 111 is formed to be connected to a refrigerant suction pipe (not shown) which is extended from a system, second passage pipe 120 having an outlet port 121 connected to a suction side of a valve assembly (not shown) so that refrigerant gas which is sucked through the first passage pipe 110 is led to a compression space of the cylinder (not shown) and an extended space 130 which is extended-formed between an outlet side of the first passage pipe 110 and an inlet side of the second passage pipe 120 connecting the two passage pipes 110 and 120.

An angle $\alpha$ formed by an extended imaginary central line of the first passage pipe 110 and an extended imaginary central line of the second passage pipe 120 is 40~50° and the extended imaginary central line of the first passage pipe 110 crosses exactly the center of an inlet end of the second passage pipe 120.

Also, the extended imaginary central line of the first passage pipe 110 may not meet a center of the inlet end of the second passage pipe 120.

Also, it is desirable that a distance L between the outlet end of flowing direction in the first passage pipe 110 and the inlet end of the second passage pipe 120 is 6~7 times longer than the diameter of the ends of respective passage pipes 110 and 120 so that the refrigerant gas flows smoothly.

The extended space 130 is divided into three parts by first compartment 131 formed first resonance hole 131*b* and second compartment 132 formed second resonance hole 132*b*, first and second resonance spaces 131*a*, 132*a* which form Helmholtz resonance part and the extended space 130 itself.

The first compartment 131 is formed to be curved and on the other hand, the second compartment 132 is formed as a straight line.

It is desirable that the first compartment 131 is formed near the channel of the two passage pipes 110 and 120 and on the other hand, the second compartment 132 is formed relatively far from the two passage pipes 110 and 120 so that the extended space 130 maintains a sufficient space.

Also, if the extended space 130 is divided into two volumes by means of the boundary of the extended line joining the center of the outlet end of the first passage pipe 110 and the center of the inlet end of the second passage pipe 120, it is desirable that the volume having a curved surface with a curvature R is smaller than one fifth of the volume of the opposite side.

Figure 6:
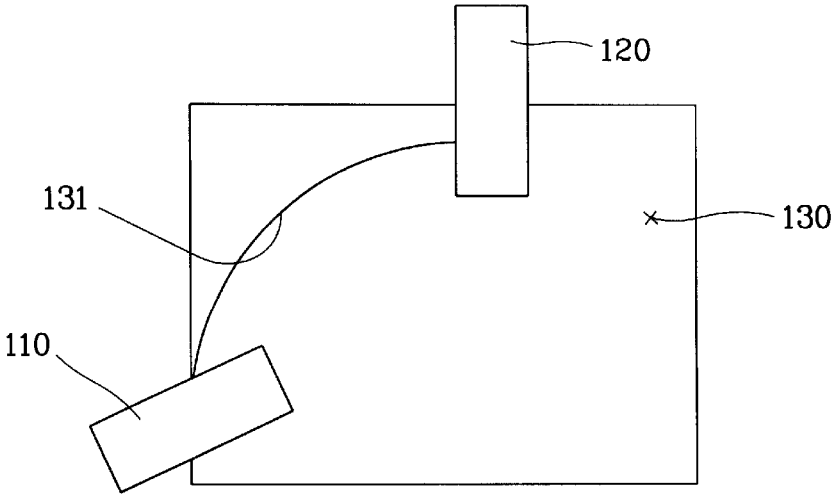
FIG. 6 is a schematic view showing an example of modification of the muffler of a compressor in accordance with the present invention.

On the other hand, as shown in FIG. 6, it is possible that the first compartment 131 is formed as a straight line and the second compartment 132 is formed curved, or it is possible that the first compartment 131 and the second compartment 132 are all formed curved.

Same parts as the conventional ones in the drawings are designated by a same reference numeral.

The operation of the suction muffler with the above composition will be described.

In case of a suction stroke of a compression unit, refrigerant gas sucked through the inlet port 111 of the first passage pipe 110 is flown to the extended space 130 through the first passage pipe 110 and again flows to the outlet port 121 through the second passage pipe 120. Then the refrigerant gas is sucked to the cylinder (not shown) of the compression unit opening the suction valve (not shown) connected to the outlet port 121.

At this time, the refrigerant gas flown to the extended space 130 through the outlet end of the first passage pipe 110 flows slipping on the curved surface of the first compartment 131 formed between the first passage pipe 110 and the second passage pipe 120 and the refrigerant which flows from the first passage pipe 110 to the second passage pipe 120 is sucked smoothly.

Then, when the compression unit begins a compression stroke the suction valve (not shown) is closed and as the pressure of the refrigerant gas flowing to the outlet end of the second passage pipe 120 suddenly increases, counter current pressure in which the refrigerant gas flows in the reverse direction again is formed.

Figure 5:
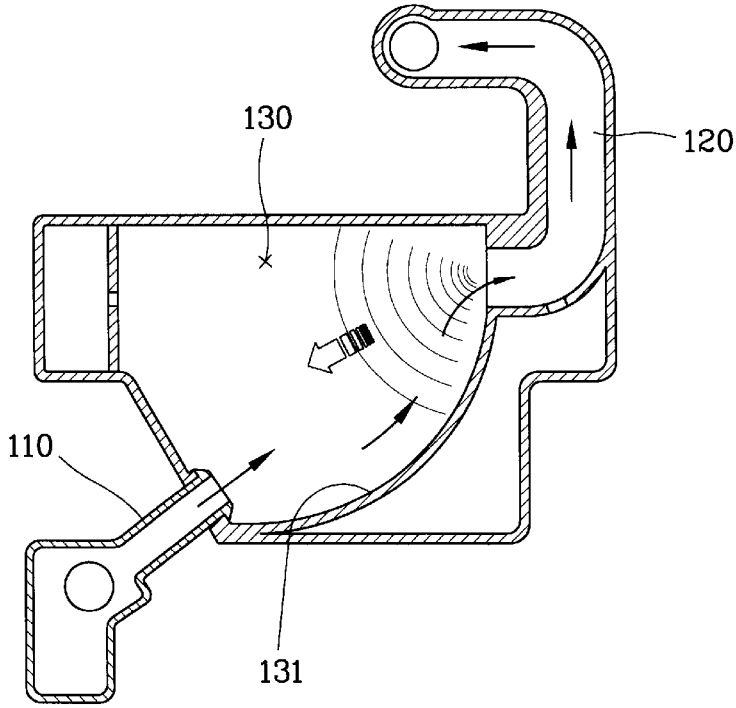
FIG. 5 is a longitudinal cross-sectional view showing the operation effect of the muffler of a compressor in accordance with the present invention schematically.

Due to the counter current pressure, the refrigerant gas which flows backward to the second passage pipe 120 collides with the refrigerant gas which is sucked through the first passage pipe 110 and accordingly, pulsation flow is generated. However, as shown in FIG. 5, the first passage pipe 110 and the second passage pipe 120 are formed to have a proper angle and the refrigerant gas at the suction side the refrigerant gas at the counter current side are prevented from colliding directly to each other, thus to compensate the pulsation flow.

Also, the outlet end of the first passage pipe 110 and the inlet end of the second passage pipe 120 are formed to maintain a sufficient interval and accordingly, the pressure of the refrigerant gas sucked through the first passage pipe 110 and the refrigerant gas which flows through the second passage pipe 120, decreases thus to attenuate the pulsation flow.

On the other hand, the flow noise occurs when sucking the refrigerant gas or valve noise occurred during the opening and closing of the suction valve (not shown) are attenuated firstly when the noises are flown to the first resonance space 131*a* and attenuated secondly when the noises are flown to the second resonance space 132*a* through the second resonance hole 132*b*, thus to decrease the noises remarkably.

Namely, by having a curved surface between the outlet end of the first passage pipe and the inlet end of the second passage pipe the sucked refrigerant gas can flow smoothly, and by positioning the outlet end of the first passage pipe and the inlet end of the second passage pipe to have a certain angle, the pulsation flow between the refrigerant gas flowing backward and the sucked refrigerant gas can be minimized so that the refrigerant gas can flow smoothly during next suction stroke.

Also, by separating the distance between the outlet end of the first passage pipe and the inlet end of the second passage pipe, the decrease in the suction efficiency of the refrigerant gas by the pulsation flow can be prevented in advance.

In an example of a muffler of a compressor in accordance with the present invention, an extended imaginary central line of flowing direction in the passage pipe at the inlet side and an extended imaginary central line of the flowing direction in the passage pipe at the outlet side are formed to have an angle of 40~50° or the curved surface having a certain curvature R is formed in the extended space between the outlet end of the passage pipe at the inlet side and the inlet end of the passage pipe at the outlet side.

By positioning the passage pipes as in the above-described, the refrigerant gas which flows to the passage pipe at the outlet side through the passage pipe at the inlet side can flow smoothly as the refrigerant gas passes the curved surface and by attenuating the pulsation flow between the passage pipes at the inlet side and outlet side, the refrigerant gas can be sucked smoothly. Therefore, suction amount of the refrigerant gas increases, thus to improve the efficiency of the compressor.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A muffler of a compressor, comprising:

a central resonance chamber defining an extended space therein;

a first passage pipe having an outlet end at an inlet side of the central resonance chamber; and a second passage pipe having an inlet end at an outlet side of the central resonance chamber, wherein a central longitudinal axis of the first passage pipe at the inlet side and a central longitudinal axis of the second passage pipe at the outlet side form an angle of about 40° to about 50° with respect to one another.

2. The muffler of claim 1, wherein the central longitudinal axis of the first passage pipe intersects a center of the inlet end of the second passage pipe.

3. The muffler of claim 1, wherein the central longitudinal axis of the first passage pipe intersects does not intersect a center of the inlet end of the second passage pipe.

4. The muffler of claim 1, wherein a diameter of the outlet end of the first passage pipe is approximately equal to a diameter of the inlet end of the second passage pipe, and wherein a distance between the outlet end of the first passage pipe and the inlet end of the second passage pipe is from about six to seven times longer than a diameter of the outlet end of the first passage pipe.

5. The muffler of claim 1, further comprising:

a first resonance chamber defining a first resonance space, wherein the first resonance space is connected to the extended space by a first resonance hole; and a second resonance chamber defining a second resonance space, wherein the second resonance space is connected to the second passage pipe by a second resonance hole.

6. A muffler of a compressor, comprising:

a central resonance chamber defining an extended space therein;

a first passage pipe having an outlet end at an inlet side of the central resonance chamber; and a second passage pipe having an inlet end at an outlet side of the central resonance chamber, wherein a wall of the central resonance chamber comprises a curved surface having a substantially constant curvature that extends between the outlet end of the first passage pipe and the inlet end of the second passage pipe.

7. The muffler of claim 6, wherein a line extending between a center of the outlet end of the frat passage pipe and a center of the inlet end of the second passage pipe divides the extended space into a first volume and a second volume, wherein a side of the first volume is bounded by the curved surface, and wherein the first volume is smaller than about one fifth of the second volume.

8. The muffler of claim 6, wherein a diameter of the outlet end of the first passage pipe is approximately equal to a diameter of the inlet end of the second passage pipe, wherein a distance between the outlet end of the first passage pipe and the inlet end of the second passage pipe is about six to seven times longer than a diameter of the outlet end of the first passage pipe.

9. The muffler of claim 6, further comprising:

a first resonance chamber defining a first resonance space therein, wherein the first resonance space is in communication with the extended space through a first resonance hole; and a second resonance chamber defining a second resonance space therein, wherein the second resonance space is in communication with the second passage pipe through a second resonance hole.

10. The muffler of claim 1, wherein the second passage pipe comprises a cylindrically shaped inlet.

11. The muffler of claim 1, wherein the inlet end of the second passage pipe is substantially flush with a wall of the central resonance chamber.

12. A muffler of a compressor, comprising:

a central resonance chamber defining an extended space therein;

a first passage pipe having an outlet end at an inlet side of the resonance chamber; and a second passage pipe having an inlet end at an outlet side of the resonance chamber, wherein a central longitudinal axis of the first passage pipe a central longitudinal axis of the second passage pipe are configured to form an angle of about 40° to 50°, and wherein the resonance chamber comprises a wall having a substantially constant curvature extending between the outlet end of the first passage pipe and the inlet end of the second passage pipe.

13. The muffler of claim 12, wherein the central longitudinal axis of the first passage pipe intersects a center of the inlet end of the second passage pipe.

14. The muffler of claim 12, wherein the central longitudinal axis of the first passage pipe does not intersect a center of the inlet end of the second passage pipe.

15. The muffler of claim 12, wherein a line extending between a center of the outlet end of the first passage pipe and a center of the inlet end of the second passage pipe divides the extended space into a first and second volume, wherein a side of the first volume is bounded by the wall comprising a curved surface, and wherein the first volume is smaller than about one fifth of the second volume.

16. The muffler of claim 12, wherein a diameter of the outlet end of the first passage pipe is approximately equal to a diameter of the inlet end of the second passage pipe, wherein a distance between the outlet end of the first passage pipe and the inlet end of the second passage pipe is about six to seven times longer than a diameter of the outlet end of the first passage pipe.

17. The muffler of claim 12, further comprising:

a first resonance chamber defining a first resonance space therein, wherein the first resonance space is in communication with the extended space through a first resonance hole; and a second resonance chamber defining a second resonance space therein, wherein the second resonance space is in communication with the second passage pipe through a second resonance hole.

* * * * *